US005713376A

United States Patent [19]

Berger

[11] Patent Number: 5,713,376

[45] Date of Patent: Feb. 3, 1998

[54] NON-ADDICTIVE TOBACCO PRODUCTS

[76] Inventor: Carl Berger, 315A Shore Dr., Highlands, N.J. 07732

[21] Appl. No.: 645,424

[22] Filed: May 13, 1996

[51] Int. Cl.[6] ..... A24B 15/10; A24B 15/18; A24F 47/00

[52] U.S. Cl. ..... 131/270; 131/297; 131/359; 131/360; 131/352

[58] Field of Search ..... 131/352, 359, 131/297, 360, 270

[56] References Cited

U.S. PATENT DOCUMENTS

| | | | |
|---|---|---|---|
| 1,671,259 | 5/1928 | Schloesing | 131/297 |
| 1,876,214 | 9/1932 | Faitelowitz | 131/297 |
| 3,151,118 | 9/1964 | Moser | 131/297 X |
| 3,612,065 | 10/1971 | Rosen | 131/297 X |
| 4,694,842 | 9/1987 | Kobayashi | 131/352 X |
| 4,924,888 | 5/1990 | Perfetti et al. | 131/360 X |
| 5,018,540 | 5/1991 | Grubbs et al. | 131/297 |
| 5,488,962 | 2/1996 | Perfetti | 131/270 |
| 5,497,792 | 3/1996 | Prasad et al. | 131/297 |

FOREIGN PATENT DOCUMENTS

| | | | |
|---|---|---|---|
| 0023808 | of 1900 | United Kingdom | 131/297 |

OTHER PUBLICATIONS

Leffingwell et al., *Tobacco Flavoring For Smoking Products*, pp. 1, 3, 4, 5, 6, 7, 11, 35, 1972.

*Primary Examiner*—Vincent Millin

*Attorney, Agent, or Firm*—Watov & Kipnes, P.C.

[57] ABSTRACT

Cut tobacco used for processing cigarettes or other smoking articles is reacted with an agent such as an oxidant or subject to an extraction/removal process for a suitable period of time, dependent upon the nicotine content, the oxidant employed and the reaction temperature or extraction condition, or distillation, such that the nicotine embedded in the leaf is then converted into nicotinic acid or niacin. Sufficient conversion or extraction or distilled is allowed to occur so that either no nicotine or only a minimal amount of free nicotine remains in the smoking article. Upon intake into the lungs and hence the blood stream of the smoker or other tobacco user, the smoker or tobacco user will result in a blood plasma content of nicotine ranging from 0 to less than about 5 nanograms per milliliter of blood plasma. This effectively insures that the addictive process in smoking or other tobacco intake cannot he initiated or maintained. Nicotinic acid or niacin is not an addictive component of the tobacco. The niacin thus formed is located in the interstices or on the surface of the tobacco and when inhaled, actually serves as a beneficial nutrient, such as a vitamin. Flavorants can be added for taste and other non-addictive stimulants can be used to produce a heightened sense of awareness or well being.

19 Claims, No Drawings

NON-ADDICTIVE TOBACCO PRODUCTS

BACKGROUND OF THE INVENTION

1. Field of the Invention

This invention relates in general to certain new and useful improvements in processing of tobacco to eliminate or convert nicotine in the tobacco into nicotinic acid as a harmless or beneficial product such that the nicotine level which can be achieved by use of the tobacco product results in a blood plasma level consonant with non-addiction.

2. Brief Description of the Related Art

The effect of nicotine in tobacco on the central nervous system primarily is located in the locus ceruleus, which produces increased mental activity, as well as in the mesolimbic center, which stimulates the desire for more nicotine, giving rise to nicotine addiction. The basic cause of addiction lies in the inhalation of small amounts of nicotine and the circulation in the blood of amounts of nicotine in the order of twenty to twenty-five nanograms per milliliter. Conventional cigarettes contain a varying range of nicotine content which may vary, for example, from about 0.2% to about 5%.

It is also well known that the smoking of tobacco products generates other deleterious components, such as tars, and upon combustion, carbon monoxide. It is also well established, (New Scientist, 1938, Aug. 13, 1994 v. 143, page 10), that about one to three milligrams of nicotine will be absorbed in the lungs during each smoking interval. Information exists on the proof of the addictive properties of nicotine in the aforementioned New Scientist article.

There is a wealth of literature relevant to the elimination of deleterious substances, such as the nicotine and tar from tobacco products. U.S. Pat. No. 5,240,014 teaches of the catalytic conversion of carbon monoxide. U.S. Pat. No. 5,158,099 teaches of a wetted impact barrier for reduction of tar and nicotine. U.S. Pat. No. 4,700,723 teaches of a filter consisting of a fibrous ion exchange resin which removes ionic and carcinogenic constituents, as well as nicotine and tar from the tobacco smoke. U.S. Pat. No. 4,250,901 describes a chemical denaturant, such as water, to eliminate or trap nicotine, tar and carbon monoxide. However, each of these approaches are highly impractical. As an example, nicotine reacted with peroxide results in n-methylpyrolle pyridine and nicotinic acid and in which the n-methylpyrolle pyridine is far less than a healthful addition to a tobacco product.

The prior art also teaches of the extraction of nicotine from a raw tobacco product by steaming procedures. For example, in German Patent No. 25,403 by Dr. Johannes Sartig using super heated steam. In like matter, and in related techniques, U.S. Pat. Nos. 2,525,784 and 525,785 teach of the use aluminum sulfate and ammonia-ethylene dichloride to separate nicotine from raw tobacco product.

In addition to the foregoing, various nicotine blood plasma antagonists have also been suggested for use in eliminating nicotine addiction. However, these antagonists, such as mecamylamine, have only proved partially successful, if at all. One practical solution, however, to the nicotine addiction problem is suggested in this application namely a chemical conversion of the nicotine in tobacco to obviate its effect on the acetylcholine brain receptor. The alternative use of antagonists however only lends itself to expensive long term basic research and with vanishingly small chances of success.

There is other patent literature available which has tangential relationship to the use of modified tobacco products or agents related to the use of tobacco products. U.S. Pat. No. 5,122,366 teaches of the incorporation of silver nitrate in mouthwash to reduce nicotine taste from the mouth after smoking and ingestion of nicotine into the lungs. However, this is obviously no impediment to an addictive process. U.S. Pat. No. 4,620,554 uses a composition for enhancing the taste of cigarettes and which includes a filter containing ascorbic acid, powdered vegetable oil and fats, comfrey leaves, wheat protein, beef stock plant and a flavorant, such as a Japanese mint and vanilla. The effect of the composite is to produce a mellow taste and less irritation. Nicotine and the tar are absorbed by the oils and the fats and the ascorbic acid and its isomers decrease the nicotine, tar and carbon monoxide which is drawn into the lungs of the user. Potassium nitrate is also incorporated in the filter and improves combustion and catalyzes nicotine to nicotinic reaction.

U.S. Pat. No. 3,943,940 teaches of the contacting of potassium permanganate to oxidize nicotine just before smoking. However, this technique is quite awkward and expensive and not amenable to widespread public acceptance. More importantly, the results have been found to be quite variable and have no relationship to the amount of nicotine ingested by the individual.

Notwithstanding the foregoing, none of the proposed approaches for modifying tobacco have recognized any relationship between the amount of nicotine present and the amount absorbed in the blood stream of the user compared to the addictive effects thereof. Nevertheless, the importance of nicotine in the addictive process is indicated in the Wall Street Journal of Oct. 18, 1995, where it was acknowledged that diammonium phosphate (DAP) increases nicotine delivery in reduced nicotine and tar cigarettes.

OBJECTS OF THE INVENTION

It is, therefore, one of the primary objects of the present invention to provide a tobacco product adapted for human use and which eliminates an addictive response to the user thereof.

It is another object of the present invention to provide an improved tobacco product of the type stated which utilizes an oxidized tobacco in which nicotine has been converted to nicotinic acid or extraction to a level such that when used, the blood plasma nicotine level resulting in the user is about 0 to about 5 nanograms per milliliter.

It is a further object of the present invention to provide an improved tobacco product of the type stated in which a tobacco product is converted chemically or by physical means to obviate any effects on the acetylcholine brain receptors in an individual smoking or otherwise ingesting such tobacco product.

It is an additional object of the present invention to provide an improved tobacco product of the type stated which can be produced at a relatively low cost and which is highly effective in eliminating any addictive response.

It is another salient object of the present invention to provide a method for altering a tobacco product in order to reduce the nicotine content therein to a level where the resulting nicotine blood plasma level of the user has a range of about 0 to 5 nanograms per milliliter of blood.

With the above and other objects in view, my invention resides in the novel features of the modified tobacco product and the process for the same as hereinafter described and pointed out in the claims.

SUMMARY OF THE INVENTION

In accordance with the present invention, it has been found that by converting the nicotine of a tobacco product into a harmless and actually beneficial substance, such as nicotinic acid, addiction to the tobacco product can be avoided. Conversion allows for a tobacco product relatively free of nicotine and when taken into the lungs does not result in or sustain addiction. The addictive nature of the nicotine is eliminated when the resultant amount of the nicotine in the blood plasma of a user has a level of about 0 to about 5.0 nanograms of nicotine per milliliter of blood.

Nicotine intake in women was measured by the presence of cotinine, which is an oxidative metabolite of nicotine, and was detected in 84% of the female smokers and found in the cervical mucous. See J. Cancer Epidemiol, Biomarkers Prev. 1992 (1)(2) 125–9. In numerous other citations in the literature, there is described a movement of nicotine into the blood plasma and then into vital organs. Indeed, the impact of nicotine on heart and pulmonary system and the resultant formulation of neoplastic conditions in the body is well known and acknowledged in the art.

The important aspect of the present invention is the actual finding that nicotine addiction can be reduced and completely eliminated by use of smoking devices such as cigarettes in which the nicotine content is sufficiently small so that when introduced into the blood stream of a user, it will not cause a nicotine level exceeding 0 to about 5 nanograms of per milliliter of blood plasma. This can be easily accomplished by conventional oxidation techniques or steamed installation/extraction techniques known in the prior art for removal of nicotine. It can also be more readily accomplished by the oxidation of the nicotine.

The key to the use of an economical treatment of a tobacco leaf or processed tobacco are those chemical agents capable of converting nicotine into a neutral or beneficial compound which does not require removal from the tobacco or any surrounding matrix. Moreover, use of preferred chemical or oxidizing agents render the content of tar in the tobacco less noxious or otherwise, more solubilized if extraction of the tars is required.

In accordance with the present invention, there is provided an improved tobacco product adapted for human use and which eliminates an addictive response in the user. The improved tobacco product has been oxidized under conditions in which the nicotine contained in the product has been converted to nicotinic acid to a level such that the resulting nicotine concentration in the blood plasma of the user has a level of 0 to about 5 nanograms of nicotine per milliliter of blood. As indicated previously, it has been found in accordance with the present invention that when the nicotine level is reduced to about 5 nanograms per milliliter or less, there is no addictive response in the user. This is an important factor in that it has now been realized that one can actually continue to use a tobacco product without at least suffering the addictive effects which otherwise arise based on prolonged use of tobacco products.

In a more preferred embodiment of the invention, the nicotine in the tobacco product is converted to nicotinic acid by means of an oxidizing agent, such as nitric acid. Otherwise, the oxidizing agent for converting the nicotine to nicotinic acid can be selected from the class consisting of catalyzed sulfuric acid, alkaline potassium permanganate, hydrogen peroxide, ozone and combinations thereof, as well as other known oxidizing agents for this purpose.

While the literature has discussed the use of oxidizing agents for oxidizing the nicotine contained in the tobacco to nicotinic acid, no one has recognized that reducing the nicotine concentration to a level of approximately 5 nanograms of nicotine per milliliter of blood or less will eliminate the harmful addictive effects of the nicotine.

In accordance with the present invention, it is also possible to incorporate a flavoring agent in the resultant oxidized product. Further, it is also possible to incorporate in the tobacco a stimulatory agent which is non-addictive. For example, caffeine is a highly effective stimulatory agent and while it has habit forming effects, it has been generally recognized that those effects are not harmful.

The present invention also provides an improved process for enabling the use of tobacco products for human intake without any addictive response arising out of the use thereof. Again, this process comprises the converting of the nicotine contained in the tobacco product to nicotinic acid such that there is no nicotine or only a relatively small amount of nicotine remaining in the tobacco product. The process further allows the use of the converted tobacco product so that the resultant nicotine concentration in the blood stream of the user, when the tobacco product is used, is zero or less than about 5 nanograms of nicotine per milliliter of blood. As indicated, this eliminates an addictive response to the use of the tobacco product.

The complexity of nicotine addiction likely will result in a bifurcated approach in which the use of nicotine converted tobacco will be emphasized for pre-addictive individuals, such as the pre-addictive teenager, as opposed to the experienced smoker, already well addicted and experiencing nicotine blood level steady state concentrations from about twenty to twenty-five nanograms per milliliter or higher.

It may be that the long term strongly addicted smoker may not only require the physiological impact of this invention but that additional or concurrent auxiliary treatment may be required due to ingrained motivational factors.

This invention possesses many other advantages and has other purposes which will be made more clearly apparent from a consideration of the forms in which it may be embodied. Some of these forms will be described in detail in the following detailed description which is set forth merely for purposes of illustrating the general principles of the invention. However, it is to be understood that this detailed description is not to be taken in a limiting sense.

DETAILED DESCRIPTION OF A PREFERRED EMBODIMENT

In accordance with the present invention, it has been found that the key to effective elimination of nicotine addiction as a result of the use of tobacco products is to reduce the nicotine in the tobacco product to a level such that the resultant level of nicotine in the user is 5 nanograms or less per milliliter of blood. In effect, the tobacco product is largely converted into nicotinic acid. The chemical or oxidizing agents are preferred to oxidize the nicotine to nicotinic acid. In addition, it has been found that some tar which is contained in the oxidized tobacco product may be extracted due to the fact that it is more soluble.

Steaming procedures have been used in the prior art in an attempt to remove nicotine. However, removal by steaming is difficult and not an economically feasible production process. Superheated steam has been employed as an oxidizing medium, although not with any significant success. Aqueous aluminum sulfate and ammonia-ethylene dichloride were also used to separate out nicotine from a raw tobacco product, as set forth in U.S. Pat. No. 2,525,784 and U.S. Pat. No. 2,525,785. Thus, it has been found that the use of molecular chemical transformation is much more effective and economical in reducing the nicotine content in a raw tobacco leaf to less than a content of about 0.01 milligram or less per cigarette (i.e. about one gram) laboratory investigations have been conducted into the chemical properties of nicotine upon chemical conversion. Some of the most promising reactions are set forth below:

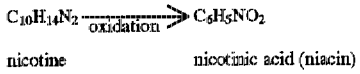

Various investigators have studied similar reactions such as Yu. I. Chumakov (Zh. Prikl. Khlm. 35, 602–5, 1962). Using nitric acid as:

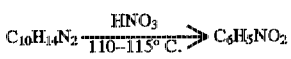

or, Phou-T. Sou and Ke-Min Wu (Hua Hsuch No. 4 135–8, 1964)

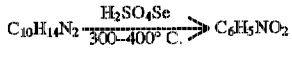

Hakon Lund (J. Chem Soc (1933) 686–7) reports the conversion of nicotine to niacin with alkaline $KMnO_4$.

There is also a large amount of patent literature relating to the above reactions, although all of the literature to date does not reflect the very essence of this present invention which is the reduction of substantially all of the nicotine and conversion to nicotinic acid which thereby results in an nicotine concentration in the blood stream of the tobacco user in an amount of about 5 nanograms per milliliter of blood or less. This level has been found to eliminate tobacco product addiction in the user.

In accordance with the present invention, it has been found that the user of a tobacco product can still continue to use the tobacco product for the other sensory effects which are provided without being addicted. Thus, the conversion of the nicotine in accordance with the present invention not only eliminates the addiction, but also reduces some of the harmful effects of the tars. In this way, a party may continue to use tobacco products without the attendant fear of becoming addicted. This is particularly effective for those parties who wish to experiment or use tobacco and who have not yet become seriously addicted to the tobacco product. Even upon smoking or other use of the product, some niacin particulates may be ingested or inhaled. This is not detrimental and indeed may be beneficial to the user. Upon inhalation of tobacco smoke or other use of the tobacco treated according to the present invention, blood levels of nicotine will not rise above 5 nanograms per milliliter of blood and will preferably approach 0 nanograms per milliliter of blood plasma.

Many users of tobacco products who already have a fairly substantial stimulation of the central nervous system excitatory nicotine responses upon use of tobacco products may require flavorants or stimulating agents or the like in order to adapt to the removal of nicotine. For this purpose, a stimulant, such as caffeine in an amount of about 50 to 200 milligrams, can be added to a cigarette, for example, during production thereof. This will result in a heightened non-addictive response by smokers. Some of the suitable flavorants which can be added include glycerine, sugar, propylene glycol, glycerin. Some of the stimulants which can be added include caffeine, phenol propylamine, psueudoephedrine. Some of these agents are described in an Ingredient Safety Assessment Booklet (March 1994) prepared by the Philip Morris Company. Approximately 599 such ingredients have been identified as being generally recognized as safe or approved.

The flavorants should be added in an amount of about 20 grams per pound of tobacco product and the stimulants should be added in an amount of about 20 grams per pound of tobacco product.

EXAMPLES

The following examples are provided in order to further illustrate the product and the method of the present invention, although it should be appreciated that the subject matter of his invention is not limited by the scope of these examples.

Example 1

One pound of smoke cured burley tobacco is treated with 2.5 gallons of an oxidizing agent having 50% of nitric acid for about thirty minutes at a temperature of about 110° to about 115° C. The burley tobacco was introduced into a glass container and the nitric acid was poured directly onto the tobacco and the tobacco was allowed to remain in the oxidizing bath in this container for the thirty minute period. After thirty minutes, the treated tobacco was rinsed with tap water and dried and thereafter cut to filler consistency in the same manner as would be used for cigarette production. This treatment would therefore allow the assay of the effectiveness of the conversion of the nicotine to nicotinic acid.

A panel of cigarette smokers was requested to cease all smoking activity for a period of 24 hours. Each of the members of the panel (12 members) were then given two packs (twenty cigarettes per pack) of the cigarettes treated in this example each day for a period of three days. Each of the smokers were allowed to smoke each of the two packs per day. Blood samples of each of the sample members were tested by flame ionization gas chromatography and enzyme immunoassay methods (in accordance with the Medtox Laboratory Bulletin). The mean blood level determined was 25 nanograms of nicotine per milliliter of blood which was determined to be more than sufficient to maintain an addiction for smoking, which indicates an addictive nicotine reaction in treated cigarettes. [See Example 2]

It was found that the nitric acid contact with the tobacco in this example was not of sufficient duration in order to convert all of the nicotine to nicotinic acid. Therefore, it is useful in connection with the present invention to insure that the nicotine content in the tobacco is less than about 0.01 mg per cigarette. Preferably, oxidation should be sufficient as for example, oxidation with alkaline potassium permanganate to produce a nicotine content of about 0.01 milligram per conventional cigarette or even less. This will result in a blood plasma level of zero to about 5 nanograms of nicotine per milliliter of blood plasma.

Example 2

One pound of tobacco was obtained from over the counter cigarettes. The nicotine content of the cigarettes was determined to be 0.6 mg per cigarette. In a manner similar to that in Example 1, the tobacco was treated with nitric acid and washed with tap water. The tobacco was then drained to remove all of the remaining nitric acid and tap water. At that point, alkaline potassium permanganate was poured onto the wet tobacco and remained in contact with the tobacco for about one hour at 50° C.

The tobacco was then filtered, washed and mixed with an aqueous solution of 20 grams of caffeine, 20 grams of sucrose and a small amount of propylene glycol. Thereafter, the tobacco was dried at 120° C. for about sixty minutes. The tobacco was then disbursed by agitation and rolled into cigarettes.

After a testing program similar to that of Example 1, the mean blood levels of the smokers was determined to be in the range of less than 5 nanograms per milliliter of nicotine. Cigarettes smoked by the panel of smokers left the smokers without a strong desire to ignite another cigarette since the blood level of nicotine in the blood was insufficient to increase the excitation ration in the limbic central nervous system.

Assays were performed by enzyme immunoassay (EIA) and gas chromatography flame ionization (GC-FID) using blood and urine samples and employing procedures described on pages 2–4 of the Medtox Laboratory Bulletin. The incorporation of caffeine and sucrose and polypropylene glycol produced a coffee "high" and a "smooth" flavor to dampen the caffeine and other after-taste.

The chemically treated tobacco upon analysis revealed the absence of nicotine concentrations greater than 0.01 milligram per cigarette indicating almost total conversion of the nicotine to nicotinic acid. When compared to Example 1, it is observed that in Example 1 there was only a partial conversion of nicotine to nicotinic acid thereby leaving a substantial amount of nicotine, whereas in the present example, there is very little nicotine remaining. The presence of nicotine in the blood plasma of smokers, using the tobacco of Example 2, was determined to be less than about 5 nanograms per milliliter of blood plasma. Indeed, the analysis of two of the panel members yielded no discernible nicotine presence. The smoking of these cigarettes by twelve individuals at a rate of two packs per day for thirty days revealed nicotine blood levels of still less than about 5 nanograms per milliliter in all of the tested panel members. In eleven of the twelve panel members, no involuntary addictive behavior was noted after smoking ceased. This was also confirmed by a psychological testing program extended over a ninety day period.

Example 3

200 grams of tobacco, which was steam tunnel volume activated, was restored to its original volume after fermentation and drying. The tobacco was reacted with five liters of 60% nitric acid at 100° C. for sixty minutes. After washing and drying, an analysis of the dried tobacco revealed nicotine content per cigarette of 0.7 milligrams. Since this would yield blood plasma levels higher than 5 nanograms per milliliter of blood, and result in a range of about 25–50 nanograms per milliliter in an individual after smoking, further oxidation of the tobacco was required. This was accomplished by introducing superoxol (100% hydrogen peroxide) into the tobacco.

After washing and drying the tobacco and incorporation into cigarettes, testing similar to that in Example 2 was performed. The results indicated a significant drop in addictive behavior in thirteen out of sixteen individuals in a panel of cigarette smokers. Seven individuals in the test group of the panel complained that flavor was absent and that the caffeine high which was present in the cigarettes they smoked from Example 2 was absent. In the tobacco of this Example 3, no caffeine and no flavorants were added. However, blood level nicotine was measured and ranged between 0–3 nanograms per milliliter of blood. This was also confirmed with analysis of urine, as well.

Example 4

Tobacco stock produced in a manner similar to that of Example 3 was treated with a solution of caffeine, sucrose and propylene glycol with the same concentrations as described in Example 2, above. Other non-prescription stimulants, such as corn syrup and honey were also used in separate experiments. The original mixture of this example was dried at 120° C. for sixty minutes and was disbursed and mixed with 200 milligrams of a mixture of ascorbic acid, citric acid and maleic acid which served to oxidize the remaining traces of nicotine to nicotinic acid.

During the oxidation of the tobacco, the reaction fluids ranged in color from beige to brown. This was determined to be an indicator of the oxidation and solubilization of the tars in the basic tobacco leaf. This also showed a meaningful lowering of the tar content in the cigarettes for the smoker.

Example 5

One pound of smoke cured burley tobacco was treated at 100° to about 150° C. in a closed vessel with superheated steam for the elimination of nicotine. Analysis showed that 10–12 steamings were required to reduce the nicotine content of the raw tobacco leaf to less than about 0.01 milligrams per cigarette. Cigarettes made of this material was tested in a manner similar to that in Example 2. In this case, the smokers in the panel of twelve smokers show blood plasma levels of 3–5 nanograms of nicotine per milliliter of blood, and this was determined to be a non-addictive level.

Example 6

One half pound of tobacco leaf product was mixed with concentrated ammonia and ethylene dichloride in a percolator for about twenty four hours. The nicotine in the mixture of the tobacco leaf, ammonia and ethylene dichloride was removed by countercurrent extraction with aluminum sulfate. The nicotine was then treated with ammonia until a pH of 8.0 was obtained. The nicotine is extracted with the ethylene dichloride and was thereafter purified by distillation.

The overall procedure as described in this Example 6 was repeated six times before nicotine content of less than 0.01 milligram per cigarette is attained. The cigarettes were tested in the same manner as in Example 2 and the tobacco is found to be non-addictive. Additional tests were made when the cigarettes were treated with non-addictive stimulatory agents and flavorants similar to that of Example 4 and it was found that user satisfaction improved.

Example 7

Tobacco products similar to those of Example 6, such as pipe tobacco, cigar tobacco and chewing tobacco were all subjected to the same type of reaction and testing as in Example 2. Subsequent blood plasma levels and urine tests on the users of the treated products also resulted in less than about 5 nanograms per milliliter of blood.

Thus there has been described, a unique and novel oxidized tobacco product and a method of achieving the oxidized tobacco product in which nicotine is substantially converted to nicotinic acid and thereby eliminates the addictive qualities of tobacco. The present invention therefore fulfills all of the objects and advantages which have been sought. It should be understood that many changes, modifications, variations and other users and applications will become apparent to those skilled in the art after considering this specification. Therefore, any and all such changes, modifications, variations and other uses and applications which may become apparent to those skilled in the art after considering this specification are deemed to be covered by the invention.

Having thus described the invention, what I desire to claim and secure by letters patent is:

1. A tobacco product comprising nicotine in an amount below about 0.01 milligram per gram of said tobacco product which is sufficiently low so that the resulting nicotine concentration in the blood plasma of a user of the tobacco product is consistently in the range of from about 0 to 5 nanograms per milliliter.

2. The tobacco product of claim 1 further comprising a flavoring agent.

3. The tobacco product of claim 1 further comprising a stimulatory agent.

4. The tobacco product of claim 1 which is in the form of a cigarette.

5. A method of preparing a tobacco product comprising treating the tobacco product with an amount of an oxidizing agent sufficient to convert nicotine to nicotinic acid so that the residual nicotine content is below about 0.01 milligram per gram of said tobacco product.

6. The method of claim 5 wherein the oxidizing agent is selected from the group consisting of catalyzed sulfuric acid, alkaline potassium permanganate, hydrogen peroxide, ozone and combinations thereof.

7. The method of claim 5 further comprising adding at least one additive to the tobacco product.

8. The method of claim 7 wherein the additive is selected from the group consisting of flavoring agents, stimulating agents and combinations thereof.

9. The method of claim 5 further comprising treating the tobacco product with a scavenger capable of reacting with trace quantities of nicotine.

10. The method of claim 5 further comprising solubilizing any tar contained in the tobacco product and removing at least a portion of the solubilized tar from the tobacco product.

11. A tobacco product produced in accordance with the method of claim 5.

12. A method for enabling the use of a tobacco product for human intake, said method comprising:

a.) treating the tobacco product to reduce the content of nicotine below about 0.01 milligram per gram of said tobacco product, and b.) using the treated tobacco product so that the resultant nicotine concentration in the blood stream of the user is consistently within the range of from about 0 to 5 nanograms of nicotine per milliliter of blood.

13. The method of claim 12 wherein the treating step comprises oxidizing, extracting or steam distilling the tobacco product.

14. The method of claim 12 further comprising adding at least one additive to the tobacco product selected from the group consisting of a flavoring agent and a stimulatory agent and combinations thereof.

15. The method of claim 12 comprising converting the nicotine in the tobacco product to nicotinic acid.

16. The method of claim 15 comprising reacting the nicotine with an oxidizing agent.

17. The method of claim 16 comprising reacting the nicotine with an oxidizing agent selected from the group consisting of catalyzed sulfuric acid, alkaline potassium permanganate, hydrogen peroxide, ozone and combinations thereof.

18. The method of claim 12 further comprising solubilizing at least some tar contained within the tobacco product and removing at least a solution of the solubilized tar from the tobacco product.

19. A tobacco product comprising nicotine in an amount sufficiently low so that the total nicotine delivery of the tobacco product results in a nicotine concentration in the blood plasma in the range of from about 0 to 5 nanograms per milliliter.

* * * * *